US006471000B2

(12) United States Patent
Wolfe

(10) Patent No.: US 6,471,000 B2
(45) Date of Patent: Oct. 29, 2002

(54) SAFETY HARNESS AND LADDER ASSEMBLY

(76) Inventor: Albert A. Wolfe, 2313 Harvard Dr., Flower Mound, TX (US) 75022

( * ) Notice: Subject to any disclaimer, the term of this patent is extended or adjusted under 35 U.S.C. 154(b) by 0 days.

(21) Appl. No.: 09/811,180

(22) Filed: Mar. 16, 2001

(65) Prior Publication Data

US 2002/0129993 A1 Sep. 19, 2002

(51) Int. Cl.[7] ..... A47L 3/04
(52) U.S. Cl. ..... 182/8; 182/9; 182/179.1
(58) Field of Search ..... 182/5, 8, 9, 179.1; 403/246, 171

(56) References Cited

U.S. PATENT DOCUMENTS

| | | | | | |
|---|---|---|---|---|---|
| 2,553,438 | A | * | 5/1951 | Caduff et al. | 182/8 |
| 2,616,609 | A | * | 11/1952 | Herod | 182/8 X |
| 3,348,632 | A | * | 10/1967 | Swager | 182/8 X |
| 3,523,591 | A | * | 8/1970 | Fountain | 182/8 |
| 4,111,280 | A | * | 9/1978 | Devine et al. | 182/8 |
| 4,235,314 | A | * | 11/1980 | Reagan | 188/73.5 |
| 4,269,284 | A | * | 5/1981 | Swager | 182/8 |
| 5,070,968 | A | * | 12/1991 | Evans | 188/79.64 |
| 5,098,213 | A | * | 3/1992 | Day | 403/7 |
| 5,238,084 | A | * | 8/1993 | Swager | 182/8 |
| 5,645,388 | A | * | 7/1997 | Lacasse | 414/227 |
| 6,109,399 | A | * | 8/2000 | Crawford et al. | 188/250 |

FOREIGN PATENT DOCUMENTS

| | | | | |
|---|---|---|---|---|
| SU | 1057042 | * | 11/1983 | 182/8 |
| WO | 94/04786 | * | 3/1994 | 182/8 |

* cited by examiner

*Primary Examiner*—Bruce A. Lev
(74) *Attorney, Agent, or Firm*—Gardere Wynne Sewell LLP; Sanford E. Warren, Jr.; Kenneth T. Emanuelson

(57) ABSTRACT

In certain embodiments, the improved safety ladder and harness assembly described herein incorporates a harness coupling designed to slide freely within the vertical member of a safety ladder so long as the forces exerted on the coupling are small. Any significant external force applied to the coupling, such as the application of a worker's weight, will result in a braking and holding action by the coupling until the external force or weight is removed. In one embodiment, the apparatus incorporates a substantially cylindrical coupling body having a braking lever extending from the front side, an upper braking nub extending from the upper portion of the coupling body in the same direction as the braking lever, and a lower braking nub extending from the lower portion of coupling body in the opposite direction as the braking lever.

17 Claims, 5 Drawing Sheets

36
38
34
32
22
24
30
40

38
36
34
32
22
24
30
40

22
24
24
16
12
20
20
18
16
12
10
16
12
18
15
14

SAFETY HARNESS AND LADDER ASSEMBLY

TECHNICAL FIELD OF THE INVENTION

The present invention relates generally to the field of construction scaffolding, and in particular to a ladder and safety harness assembly incorporating a set of features designed to improve both the functionality of the ladder and harness assembly and the safety characteristics thereof.

BACKGROUND OF THE INVENTION

In various applications, it is necessary to provide safe and structurally-sound support apparatus in order to give workers safe access to elevations above ground. For example, in the course of repairs to the outside surface of a building, modifications of the same, window washing, painting, cleaning, or installation of siding on the exterior of a building, ladders and scaffolds are commonly used to enable workers to move up and down adjacent the side of the building. Such devices are well known and take a wide variety of forms.

Although there are a number of ladder designs known in the construction art, most conventional ladders include a pair of vertical rails that are interconnected by horizontal rungs. Certain ladders are designed to be free-standing, while others are designed to rely on an external support surface. Either of these designs may be fixed to an external support by braces or other structural members, in order to increase their rigidity, stability, and structural integrity.

With respect to scaffolds, although scaffolding designs encompass a wide variety of geometries, most conventional forms of scaffolding ordinarily include a set of vertical posts or columns that are interconnected by horizontal rails and often cross-braces for added structural integrity. Generally, these assemblies may be stacked on top of each other so as to permit workmen to work at high elevations.

In order to provide workers access to multiple levels of the scaffolding, most scaffold installations incorporate ladders either integrally as part of the scaffold structure, or mounted to the scaffold structure by some form of attachment means.

Hazards to workers associated with scaffolds in general, and scaffold ladders in particular, are well known. These hazards include loss of balance and slippage. These hazards can be exacerbated by movement of workers on the scaffold, wind, and other environmental factors. In order to protect the workers against falls, safety structures and devices may be incorporated into the structure of the scaffolding and/or the scaffold ladders.

Although certain devices have been developed to improve the level of safety of workers performing tasks at high elevations, there remains a need in the art for a safety device that allows for a secure attachment between the worker and the structure while at the same time allowing the worker to move freely along the structure and quickly engage or disengage from the structure. Furthermore, there is a need for a safety device that is easy to use, reliable, and easy to manufacture.

SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

The present invention relates generally to the field of construction scaffolding, and in particular to a scaffold ladder and harness assembly incorporating a set of features designed to improve both the functionality of the ladder and the safety characteristics thereof. In its various embodiments, the present invention includes a number of novel structures and assemblies to facilitate safe and efficient use of scaffold ladders as well as improve the safety of workers using such ladders.

In one embodiment, the invention comprises a safety harness coupling having a substantially cylindrical coupling body having a front side, a back side, a center of rotation, and a braking lever extending from the front side having an attachment feature disposed therein. The coupling has a braking nub extending from one side of the coupling body and disposed about an axis non-coincident to the center of rotation of the coupling body.

In a second embodiment, the present invention comprises a safety harness and ladder assembly including a ladder having a vertical rail having a substantially cylindrical internal surface and a vertical slot disposed therein. A substantially cylindrical coupling body is disposed inside the vertical rail having a front side, a back side, a center of rotation. The coupling incorporates a braking lever extending from the front side of the coupling body and through the vertical slot and a braking nub extending from one side of the coupling body and disposed about an axis non-coincident to the center of mass of the coupling body. The braking lever has an attachment feature disposed therein for attachment to a safety harness.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

The present invention relates to a safety ladder and harness assembly designed to facilitate safe movement of workers between various portions of an elevated structure, such as, for example, a building face or scaffold. The following discussion of the safety ladder and harness assembly of the present invention is described in detail in connection with a scaffold structure, but it will be appreciated by one of skill in the art that the teachings of the present invention are applicable in any context wherein worker safety due to high elevation is a cause for concern.

Figures 1, 2A, 2B:
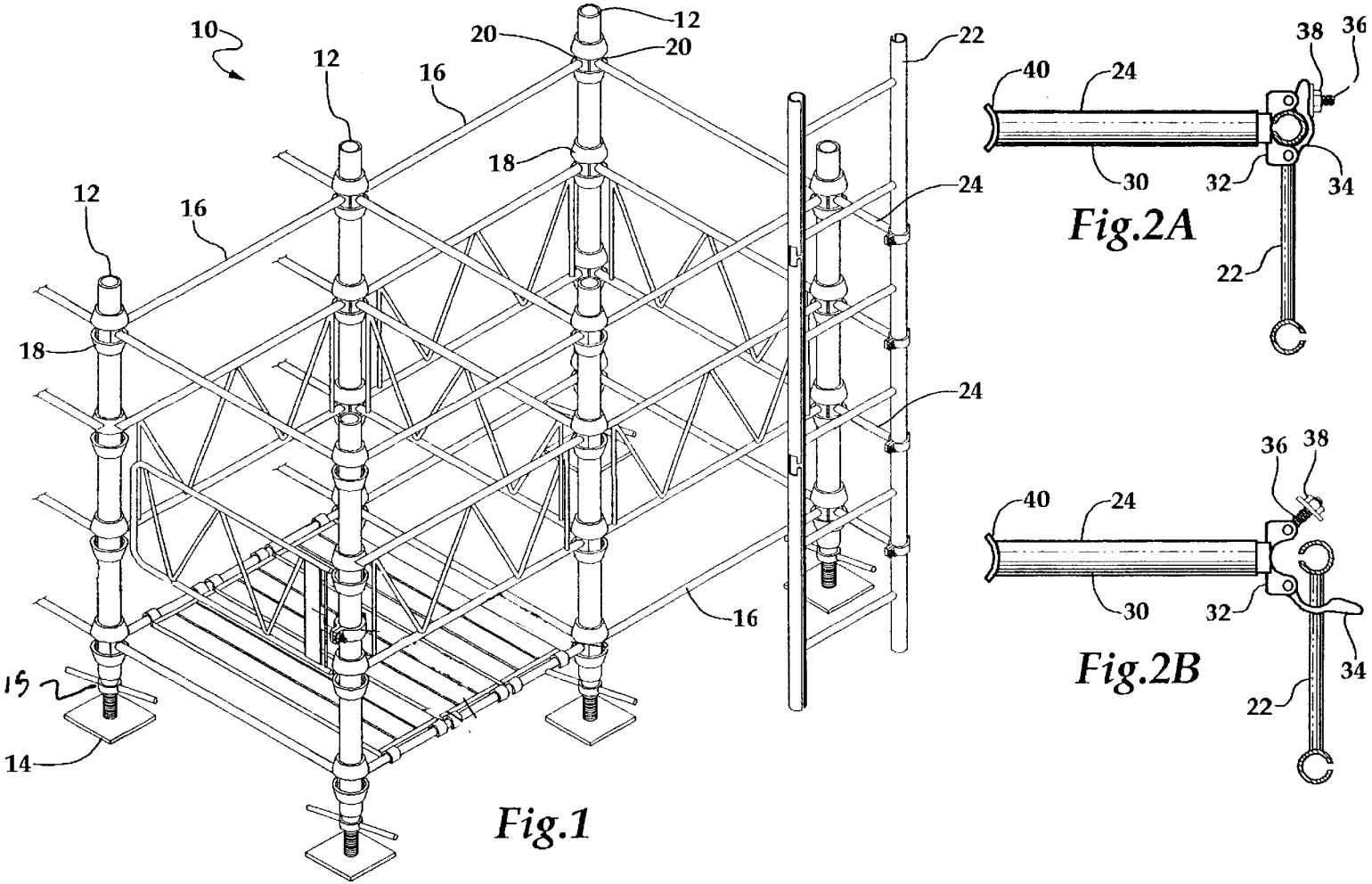
FIG. 1 is an isometric view of a scaffolding system incorporating certain embodiments of the present invention.
FIG. 2A is a top view of a ladder mounting clamp according to one embodiment of the present invention.
FIG. 2B is a top view of a ladder mounting clamp according to one embodiment of the present invention.

As noted, one area in which the ladder and harness assembly of the present invention is readily employed is in connection with scaffolding. Referring to FIG. 1, one configuration of a scaffolding system 10 is depicted. In scaffolding system 10, posts 12 provide vertical support and may be supplied with bases 14. Bases 14 may be stable platforms that function as an interface between the posts 12 and the ground or other supporting surface. In certain embodiments, bases 14 may incorporate screw-type leveling mechanisms 15 that allow the scaffolding system 10 to be erected on uneven terrain. Alternatively, bases 14 may incorporate numerous other forms of leveling mechanisms, including hydraulic mechanisms and telescoping sections secured by pins.

In certain embodiments, rails 16 may be secured to the posts 12 by couplings 18. Rails 16, as with the other portions of the scaffold, may be made of any one of a variety of materials used in structural applications, including steel, aluminum, and composite materials. The rails 16 may have any of a number of cross-sectional shapes commonly used in structural applications, including square and round tubes, I-beams, and wide-flange sections. In certain designs, the couplings 18 may be generally conical sections connected to the posts 12, though other coupling styles may be employed without departing from the spirit and scope of the present invention.

In the embodiment shown in FIG. 1, tabs 20 may be rigidly attached to the rails 16. The tabs 20 may be attached to the ends of the rails 16 by, for example, welding, bolting, or forging the tabs 20 as an integral part of the rails 16. Other methods of joining the tabs 20 to the rails 16 will be apparent to one of ordinary skill in the art.

In one embodiment of the present invention, the tabs 20 may be a part of a flange that is attached to the rail 16. Alternatively, the tabs 20 may be, for example, individual pieces of metal or other materials, such as composites, that are formed from, or attached to, the end of the rails 16. The tabs 20 may be formed from the end section of a metal rail 16, welded, screwed, or assembled in manners known to those of skill in the metalworking art. The tabs 20 may also be designed to conform to the radius of the post 12, which results in a more stable interface between the post 12 and the tabs 20.

The tabs 20 may be fixed to the rails 16 at a variety of different angles so that the scaffolding system 10 may be built to accommodate structures having irregular shapes. For example, one section of the scaffolding system 10 may be oriented at an angle greater or less than ninety degrees to the adjoining section. Varying the angles that the tabs 20 are formed or fixed to the rails 16 and varying the lengths of the rails 16 allows the scaffolding system 10 to be assembled to conform to different buildings that have a variety of shapes. As another example, various lengths of rails 16 have angled tabs 20 that allow the scaffolding system 10 to be assembled to conform to round structures, such as storage tanks.

It will be understood to one of skill in the art that the type of scaffolding system described above is only one of a number of different styles of scaffolding suitable for use in connection with the present invention. Known scaffolding designs making more extensive use of welded sections and/or bolted connections are equally suitable for use with the present invention. In fact, any structurally-sound vertical structure having some form of feature or structure suitable for attachment is suitable for use in connection with the present invention. These types of structures may include, but are certainly not limited to building frames, bridges, broadcasting towers, and petroleum drilling platforms.

Safety ladder 22, attached to scaffolding system 10 by mounting clamps 24, is designed to facilitate safe movement of workers between various portions of the scaffold system 10. In the embodiment shown in FIG. 1, safety ladder 22 is attached to post 12 using the existing couplings 18, but it will be understood by one of skill in the art that the mounting clamps 24 could be attached to posts 12 in the vertical portion between couplings 18 without departing from the spirit and scope of the present invention.

FIGS. 2A and 2B are detail views of a mounting clamp 24 of the scaffolding system incorporating certain embodiments of the present invention. Mounting clamp 24 includes strut 30, inner jaw 32, outer jaw 34, threaded shank 36, and nut 38. In FIG. 2A, clamp 24 is shown fastened to ladder 22. In FIG. 2B, mounting clamp 24 is shown in its open condition, ready to receive ladder 22 and be fastened to it.

In various embodiments, the mounting flange 40 at the opposite end of clamp 24 may be fastened to post 12 or other portions of the scaffold 10, depending on the application. Various geometries for mounting flange 40 will be dictated by the application and the structure to which it is to attach. In certain embodiments, mounting flange 40 may be designed to be a mirror image of the structure at the opposite end of strut 30, to facilitate attachment to vertical structural members. In other embodiments, mounting flange 40 may have this same structure disposed 90 degrees to the structure at the opposite end, so as to facilitate solid attachment to horizontal structural members.

In order for mounting clamp 24 to be secured to ladder 22, mounting clamp 24 must first be disposed in the open position shown in FIG. 2B. Once mounting clamp 24 is placed in the open position, the inner jaw 32, which is sized to receive ladder 22, can be moved into position around ladder 22. After inner jaw 32 is placed around ladder 22, outer jaw 34 is moved into position on the other side of ladder 22, thereby completely capturing ladder 22 between inner jaw 32 and outer jaw 34. The final steps in securing mounting clamp 24 to ladder 22 are to swing threaded shank 36 into position and to tighten nut 38, thereby securely fastening mounting clamp 24 around ladder 22.

Figure 3:
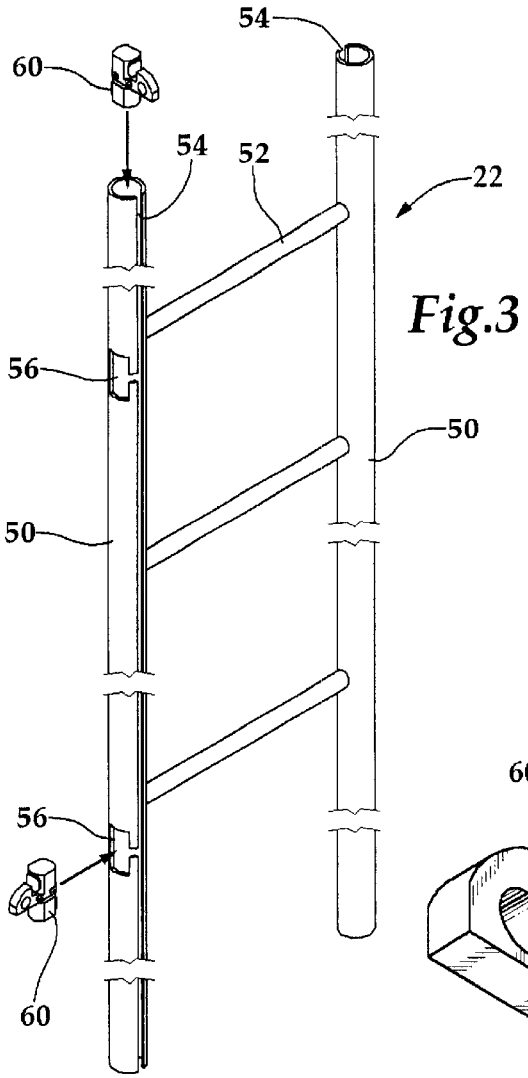
FIG. 3 is a perspective view of a scaffold ladder incorporating certain embodiments of the present invention.

FIG. 3 is a perspective view of a safety ladder 22 incorporating certain embodiments of the present invention. Ladder 22 is constructed of a pair of vertical rails 50 connected by a set of rungs 52. Vertical rails 50 and rungs 52 may be made of any number of materials known to those of skill in the art, including steel, aluminum, and composite materials. Rungs 52 may be connected to vertical rails 50 by any number of methods known to those of skill in the art, including welding, fastening, and adhesive bonding.

One or both of vertical rails 50 incorporate a vertical slot 54 in one portion of the sidewall of a vertical rail 50. In the embodiment shown in FIG. 3, ladder 22 incorporates one vertical slot 54 in each of the vertical rails 50. Although ladder 22 incorporates vertical slots 54 on opposite sides of vertical rails 54, there is nothing within the spirit and scope of the present invention necessitating such an arrangement. In various embodiments, the vertical slots 54 may be oriented on the same side of ladder 22. Similarly, while the vertical slots 54 of ladder 22 are disposed on the left side of a worker standing on ladder 22, nothing within the spirit and scope of the present invention prevents the rails from being disposed on the right side.

Vertical slots 54 within vertical rails 50 are designed to accommodate safety harness couplings 60, which are shaped and sized to slide freely inside vertical rails 50. A worker climbing on safety ladder 22 may insert one or more of safety harness couplings 60 into one or more of vertical rails 50. In certain embodiments, each safety harness coupling 60 is attached to one or more safety harnesses (not shown) the other end of which is securely attached to the worker. In the event of a slip or loss of balance, the safety harness coupling 60 is designed to slow or stop the descent of the worker. The manner of operation of the safety harness coupling 60 is described in detail below.

Certain embodiments of the present invention may incorporate one or more insertion windows 56 in the sidewall of a vertical rail 50. These insertion windows 56 enable the safety harness couplings 60 to be quickly and easily inserted and removed at a number of points along vertical rails 50.

Figure 4:
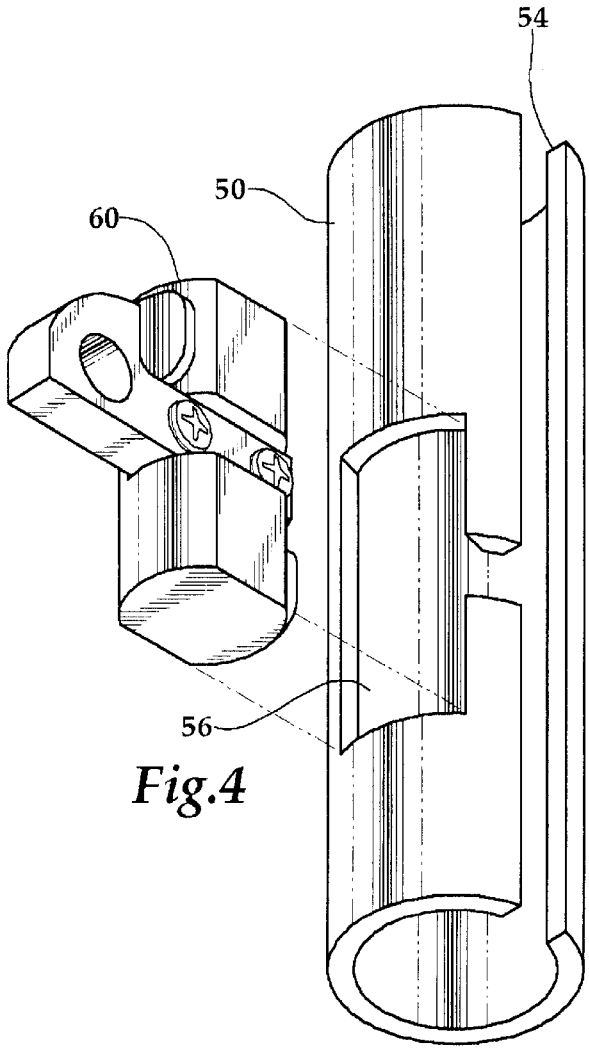
FIG. 4 is a detailed isometric view of a scaffold ladder incorporating certain embodiments of the present invention.
Figure 6A:
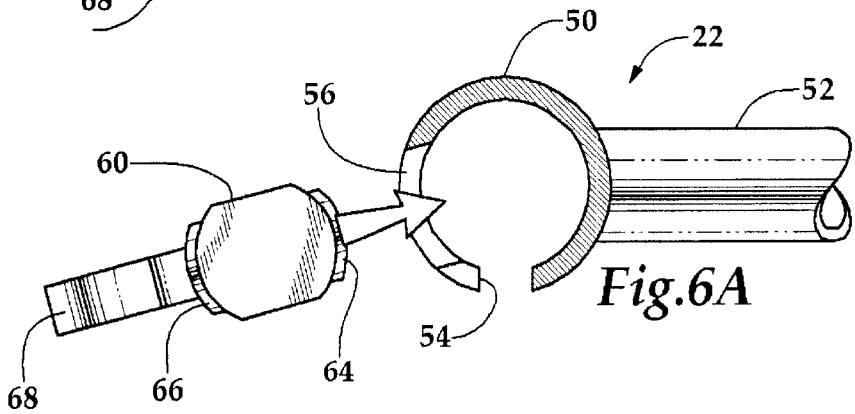
FIGS. 6A–6C are top section views of a safety ladder showing the manner of insertion of a safety harness coupling according to one embodiment of the present invention.
Figure 6B:
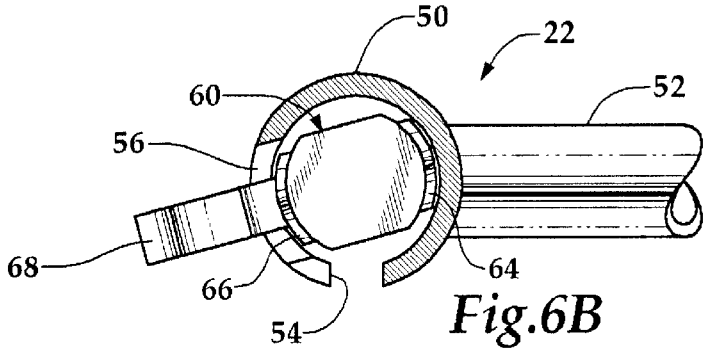
Figure 6C:
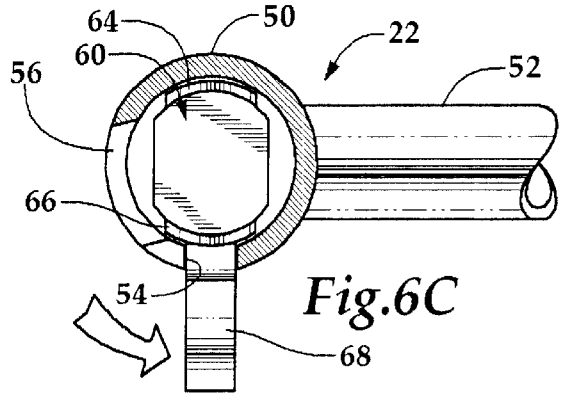

FIG. 4 is a detailed isometric view, and FIGS. 6A–6C are top section views, of a scaffold ladder vertical rail 50 showing the manner of insertion of safety harness coupling 60 through an insertion window 56 according to one embodiment of the present invention. It can be seen in these views that the insertion window 56 is designed to be a relatively close fit to the safety harness coupling 56, so as to prevent accidental disengagement from the vertical rail 50 of safety ladder 22. It can also be seen that the body of the safety harness coupling 60 is non-circular owing to the presence of two flats on the body, making the coupling significantly wider in one axis than the other.

Insertion of a safety harness coupling 60 into a vertical rail 50 of a safety ladder 22 begins with alignment of the safety harness coupling 60 with the window 56, as shown in FIGS. 4 and 6A. After proper alignment, the safety harness coupling 60 will slide readily into the center of vertical rail 50 of safety ladder 22. Once inserted into the vertical rail 50 as seen in FIG. 6B, the safety harness coupling 60 is designed to rotate within the vertical rail 50 until the protruding portion of safety harness coupling 60 is aligned with the vertical slot 54 in vertical rail 50.

Figure 5:
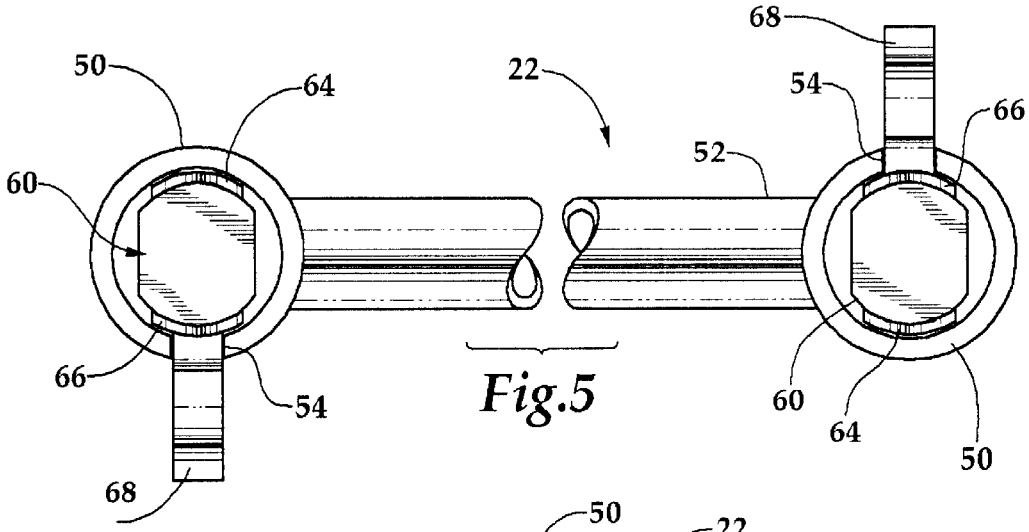
FIG. 5 is a top view of a vertical ladder member incorporating certain embodiments of the present invention.

FIG. 5 is a top view of a safety ladder 22 incorporating certain embodiments of the present invention. Safety ladder 22 is shown having two safety harness couplings 60 installed, one disposed in each of vertical rails 50 and protruding through vertical slots 54.

Figures 7A, 7B, 7C:
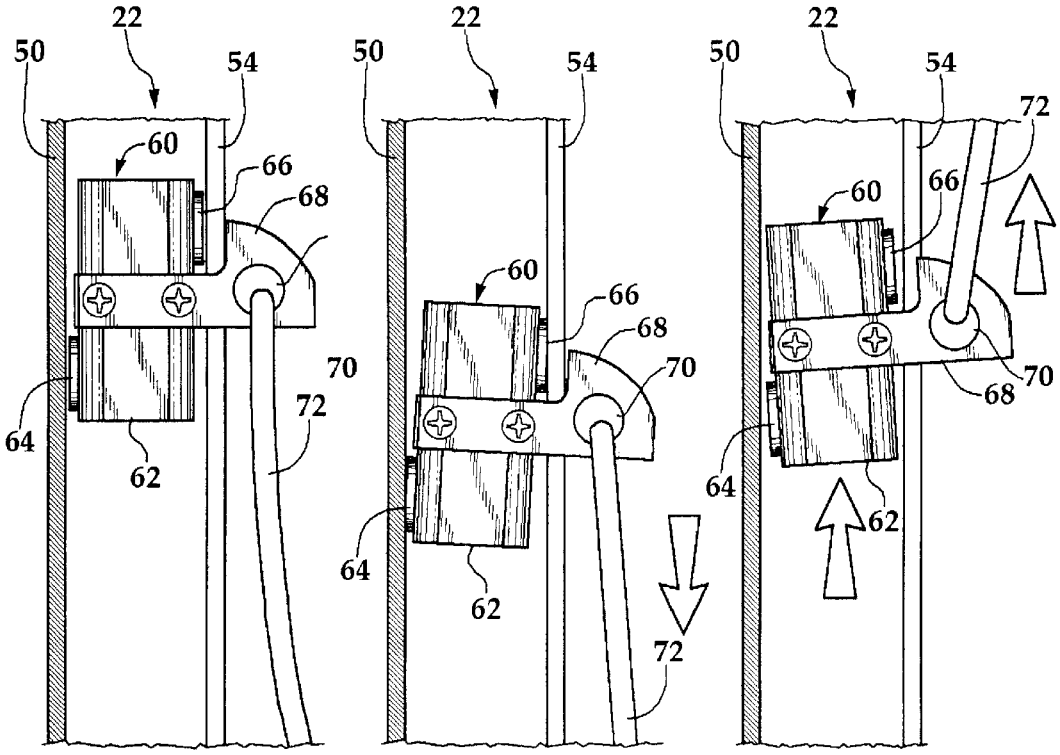
FIGS. 7A–7C is a side section view of a safety ladder showing the manner of engagement and locking of the safety harness coupling according to certain embodiments of the present invention.

FIGS. 7A–7C are side section views of a safety ladder 22 showing the manner of engagement and locking of the safety harness coupling 60 according to certain embodiments of the present invention. Safety harness coupling 60 is disposed within vertical rail 50 and under normal light-load conditions is able to slide freely in the vertical axis. Safety harness coupling 60 comprises coupling body 62, lower braking nub 64, upper braking nub 66, and braking lever 68. Braking lever 68 protrudes through vertical slot 54 and incorporates a hole 70 or other feature designed to accept a safety harness 72. Although the embodiment shown in FIGS. 7A–7C makes use of a loop geometry, it will be understood by one of skill in the art that any of the various structures known to be useful for the connection of safety devices may be employed in this capacity without departing from the spirit and scope of the present invention.

FIG. 7A depicts safety harness coupling 60 as it appears in use under a neutral or light downward load imparted by safety harness 72. As seen in this figure, safety harness coupling 60 is disposed essentially coaxially with the inner surface of vertical rail 50 and is able to slide freely within vertical rail 50 without interference.

FIG. 7B depicts safety harness coupling 60 as it appears in use under a heavy downward load imparted by safety harness 72. This is the condition to which the safety harness coupling 60 would be subjected if a worker lost his balance or slipped on a ladder rung, for example. The worker's weight is applied to braking lever 68 through safety harness 72, imparting a moment to safety harness coupling 60.

The moment applied to braking lever 68 will tend to cock safety harness coupling 60 within vertical rail 50, forcing lower braking nub 64 and upper braking nub 66 into high-pressure contact with the inner surface of vertical rail 50. As braking nubs 64 and 66 are constructed of a relatively high-friction material, this high pressure contact between the braking nubs 64 and 66 and the inner surface of vertical rail 50 will tend to brake the safety harness coupling 60 against further movement in the downward direction within the vertical rail 50. The braking nubs 64 and 66 may be constructed of any of a number of materials known to those of skill in the art as being useful in braking applications, including but not limited to certain appropriate polymers, elastomers, metals, ceramics, and composite materials.

FIG. 7C depicts safety harness coupling 60 as it appears under the application of a strong upward load. It can be seen in this figure that the rotation of safety harness coupling 60 under an upward load is such that the braking nubs 64 and 66 are moved completely out of contact with the inner surface of vertical rail 50, so that little or no braking is exhibited under these conditions.

Figures 8A, 8B:
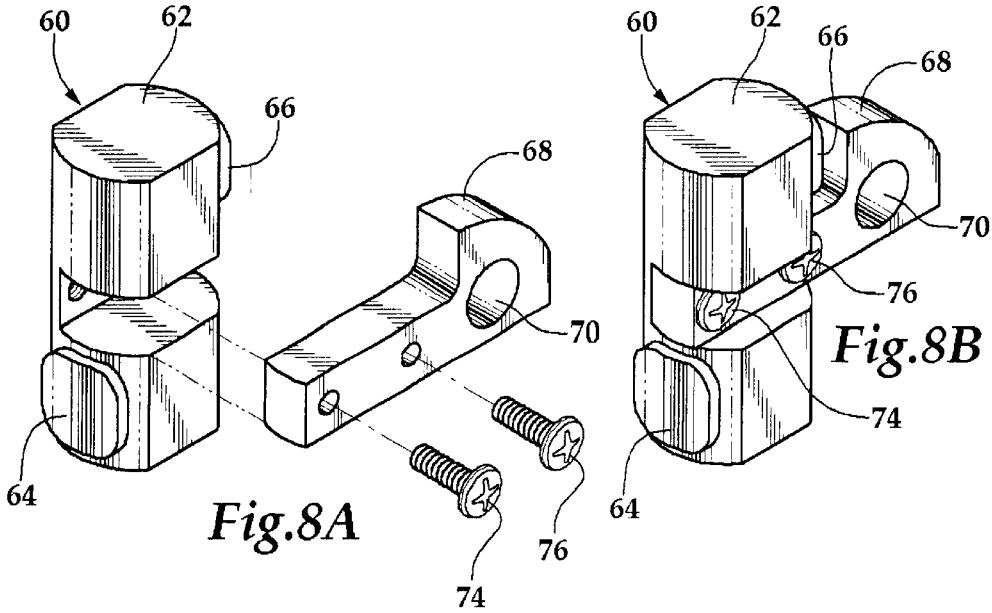
FIGS. 8A and 8B are isometric views of showing the safety harness coupling assembly according to certain embodiments of the present invention.

FIGS. 8A and 8B are isometric views of showing the safety harness coupling 60 according to certain embodiments of the present invention. In this embodiment, coupling body 62, containing braking nubs 64 and 66, is attached to braking lever 68 by threaded fasteners 74 and 76. In alternate embodiments, coupling body 62 and braking lever 68 may be formed as one piece, or may be attached using any one of a number of methods known to those of skill in the art, including welding, brazing, or adhesive bonding. In certain embodiments, braking lever 68 may be assembled to coupling body 62 using an interference fit. Other methods of assembly will be apparent to one of skill in the art.

Figure 9A:
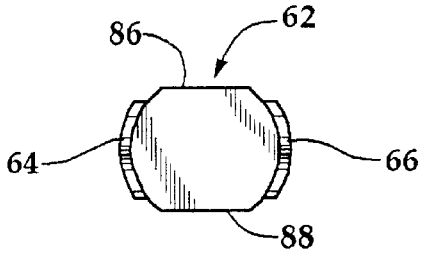
FIGS. 9A–9C are principle axis views of a safety harness coupling body according to certain embodiments of the present invention.
Figure 9B:
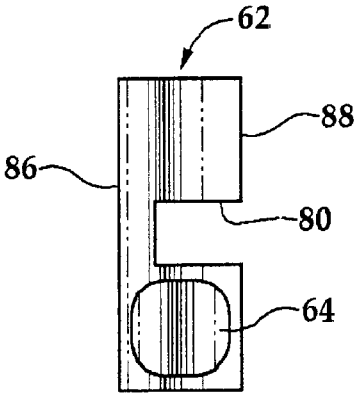
Figure 9C:
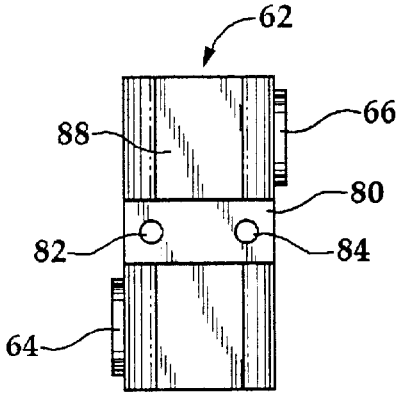

FIGS. 9A–9C are principle axis views of a safety harness coupling body according to certain embodiments of the present invention. As seen in these figures, coupling body 62 has a generally cylindrical shape with a channel 80 formed therein approximately transverse to the principal axis of the coupling body 62. In alternate embodiments, channel 80 may have alternate shapes depending upon the shape of the braking lever 68 employed. For example, channel 80 may in certain embodiments be a smooth wall cylindrical hole or a threaded hole designed to accept a threaded braking lever 68.

In the embodiment shown in FIGS. 9A–9C, the coupling body 62 incorporates two threaded holes 82 and 84 disposed within channel 80. Holes 82 and 84 are sized and positioned to accept threaded fasteners for fastening braking lever 68 to coupling body 62. Alternate embodiments may incorporate more or fewer threaded holes without departing from the spirit and scope of the present invention.

In the embodiment shown in FIGS. 9A–9C, coupling body 62 incorporates flats 86 and 88 to provide a narrowed cross-section width. This narrowed cross-section width allows the coupling body 62 to be removed from a window 56 in the side of a safety ladder vertical rail 50. Various embodiments may incorporate flats 86 and 88 or not, as requirements dictate.

Figure 10A:
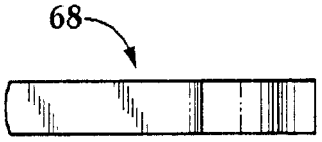
FIGS. 10A and 10B are principle axis views of a safety harness coupling locking lever according to certain embodiments of the present invention.
Figure 10B:
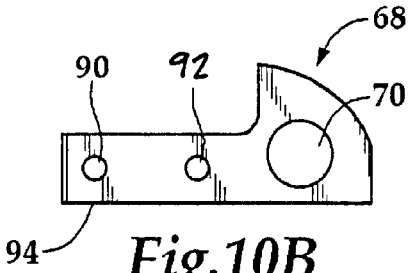

FIGS. 10A and 10B are principle axis views of a safety harness coupling braking lever 68 according to certain embodiments of the present invention. Braking lever 68 is designed to assemble to coupling body 62, thereby forming a complete safety harness coupling 60. A safety harness is attached through hole 70, which is disposed in the portion of the braking lever 68 designed to protrude through vertical slot 54 in vertical rail 50.

Braking lever 68 incorporates fastener holes 90 and 92 sized and positioned to correspond to threaded holes 82 and 84 in the coupling body 62. Alternate embodiments may incorporate more or fewer holes as requirements dictate. Certain embodiments of the present invention may use non-threaded attachment schemes, in which case fastener holes 90 and 92 would not be necessary. In this embodiment, the shank 94 of the braking lever 68 has a generally rectangular shape, but nothing within the spirit and scope of the present invention necessitates such a geometry. In alternate embodiments, braking lever 68 may have a cylindrical shape and be designed to mate with a hole in the body of coupling body 62.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

What is claimed is:

1. A safety harness coupling comprising:

a substantially cylindrical coupling body having a principal axis, a front side, a back side, a center of rotation, an upper portion, a lower portion and a braking lever extending from the front side in a direction orthogonal to the principal axis of the coupling body having an attachment feature disposed therein;

an upper braking nub extending from the upper portion of the coupling body in the same direction as the braking lever; and a lower braking nub extending from the lower portion of coupling body in the opposite direction as the braking lever.

2. The safety harness coupling of claim 1 wherein the coupling body is steel.

3. The safety harness coupling of claim 1 wherein the braking nubs are made of an elastomer.

4. The safety harness coupling of claim 1 wherein the braking nubs are made of a polymer.

5. The safety harness coupling of claim 1 wherein the braking nubs are made of a composite material.

6. The safety harness coupling of claim 1 wherein the braking lever is attached to the coupling body by fasteners.

7. The safety harness coupling of claim 1 wherein the coupling body has at least one flat portion therein.

8. A safety harness and ladder assembly comprising:

a ladder having a vertical rail having a substantially cylindrical internal surface and a vertical slot disposed therein;

a substantially cylindrical coupling body disposed inside the vertical rail and having a principal axis, a front side, a back side, a center of rotation, an upper portion, a lower portion and a braking lever extending from the front side of the coupling body in a direction orthogonal to the principal axis of the coupling body and through the vertical slot and having an attachment feature disposed therein an upper braking nub extending from the upper portion of the coupling body in the same direction as the braking lever; and a lower braking nub extending from the lower portion of coupling body in the opposite direction as the braking lever.

9. The safety harness and ladder assembly of claim 8 wherein the ladder is steel.

10. The safety harness and ladder assembly of claim 8 further comprising a window in the side of the vertical rail for insertion and retrieval of the coupling body.

11. The safety harness and ladder assembly of claim 8 wherein the braking nubs are made of a polymer.

12. The safety harness and ladder assembly of claim 8 wherein the braking nubs are made of a composite material.

13. The safety harness and ladder assembly of claim 8 wherein the braking lever is attached to the coupling body by fasteners.

14. The safety harness and ladder assembly of claim 8 wherein the coupling body has at least one flat portion therein.

15. The safety harness and ladder assembly of claim 14 wherein the coupling body has two flat portions therein disposed opposite one another.

16. The safety harness and ladder assembly of claim 8 wherein the ladder is made of tubular steel.

17. The safety harness and ladder assembly of claim 8 wherein the ladder has two vertical rails, each having a vertical slot disposed therein.

* * * * *